United States Patent [19]

McBride

[11] Patent Number: 4,572,528

[45] Date of Patent: Feb. 25, 1986

[54] GRASS SKI

[76] Inventor: Curtis J. McBride, 1710 N. Cuyamaca St., El Cajon, Calif. 92020

[21] Appl. No.: 493,285

[22] Filed: May 10, 1983

[51] Int. Cl.[4] ..... A63C 17/10

[52] U.S. Cl. ..... 280/11.1 ET; 305/35 EB

[58] Field of Search ..... 280/11.1 ET; 305/35 EB, 305/35 R, 16

[56] References Cited

U.S. PATENT DOCUMENTS

| | | | |
|---|---|---|---|
| 279,105 | 6/1883 | Purdy | 280/11.1 ET |
| 342,457 | 5/1886 | Peirce | 280/11.1 R |
| 342,458 | 5/1886 | Peirce | 280/11.1 ET |
| 675,824 | 6/1901 | Fohr | 280/11.1 ET |
| 889,946 | 6/1908 | Miller | 280/11.1 ET |
| 1,508,218 | 9/1924 | Chevreau | 280/11.1 ET |
| 1,583,114 | 5/1926 | Bierly | 280/11.1 ET |
| 1,694,162 | 12/1926 | Buitenkamp | 280/11.1 ET |
| 1,960,234 | 5/1934 | Eckels | 208/173 |
| 2,253,012 | 8/1941 | Benner et al. | 280/11.10 |
| 2,260,027 | 10/1940 | Hotson | 280/11.1 ET |
| 2,403,885 | 7/1946 | Thompson | 280/7.13 |
| 2,412,290 | 12/1946 | Rieske | 280/11.10 |
| 2,485,756 | 10/1949 | Meehan | 280/7.13 |
| 3,403,919 | 10/1968 | Weibling | 280/7.13 |
| 3,522,951 | 8/1970 | Tyson | 280/11.10 |
| 3,722,900 | 3/1973 | Dickert | 280/7.13 |
| 3,856,321 | 12/1974 | Solymosi | 280/87.04 |
| 3,926,449 | 12/1975 | Wilje | 280/11.23 |
| 3,927,706 | 8/1974 | Milliman | 280/11.10 |
| 4,134,600 | 1/1979 | McDonald et al. | 280/87.04 |
| 4,337,961 | 7/1982 | Covert et al. | 280/87.04 |

FOREIGN PATENT DOCUMENTS

| | | |
|---|---|---|
| 609234 | 11/1960 | Canada . |
| 233875 | 4/1911 | Fed. Rep. of Germany . |
| 397668 | 2/1923 | Fed. Rep. of Germany . |
| 1809935 | 6/1970 | Fed. Rep. of Germany . |
| 2219509 | 10/1973 | Fed. Rep. of Germany . |
| 2552959 | 6/1977 | Fed. Rep. of Germany . |
| 2651670 | 5/1978 | Fed. Rep. of Germany . |
| 442225 | 8/1912 | France . |
| 1436517 | 3/1966 | France . |
| 6749 | of 1900 | United Kingdom . |

*Primary Examiner*—Joseph F. Peters, Jr.
*Assistant Examiner*—Everett G. Diederiks, Jr.
*Attorney, Agent, or Firm*—Baker, Maxham, Callan & Jester

[57] ABSTRACT

A grass ski for enabling skiing on a grass covered sloped surface without the presence of snow includes a flexible runner defined by an endless guide track on which is mounted boot supports and bindings for attachment to ski boots and on which is movably mounted an endless belt supported on rollers on the endless guide track for supporting an individual for movement along the ground's surface.

9 Claims, 5 Drawing Figures

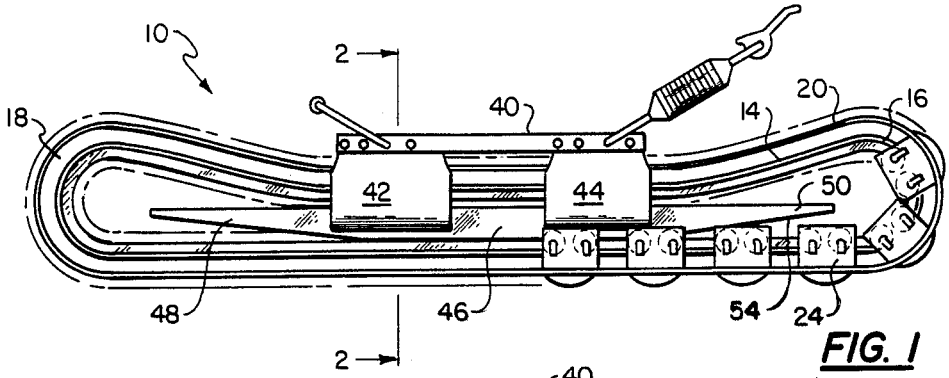
FIG. 1
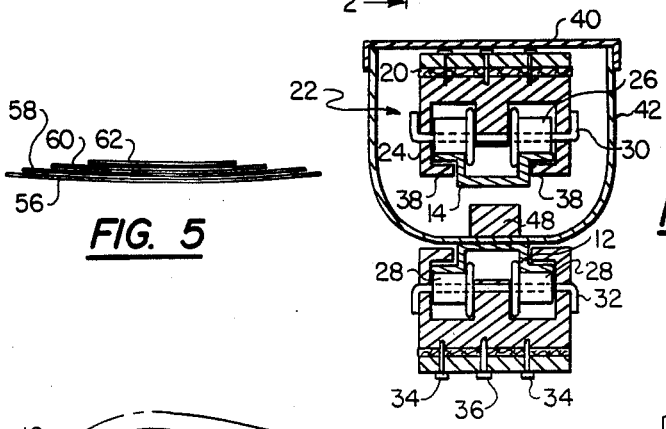
FIG. 2
FIG. 5
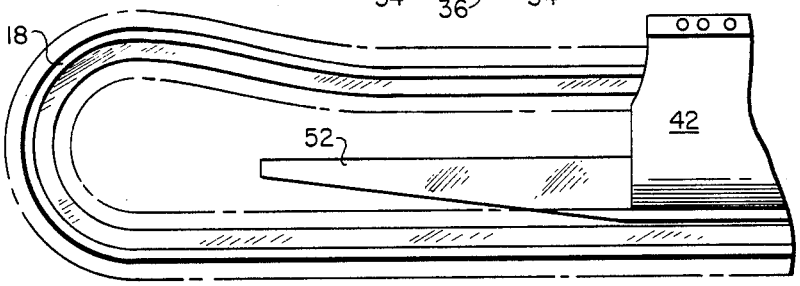
FIG. 3
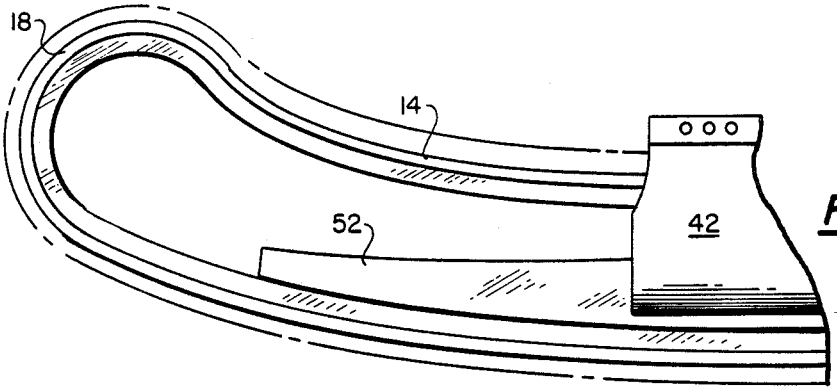
FIG. 4

GRASS SKI

BACKGROUND OF THE INVENTION

The present invention relates to the sport of skiing and pertains particularly to improved grass skis.

Many devices have been proposed in the past to enable one to enjoy the sport of skiing without the necessity of snow or specially prepared ski slopes. Such devices take many forms which the present is of a type known particularly as a grass ski in that it is designed primarily for use on grass covered surfaces and slopes.

The generally preferred form of the grass ski employs a track laying device employing belts or chains that are supported on rollers on a rather rigid runner so that the device is totally supported on the endless belt or chain which lays down as the device moves across the surface. Such devices normally employ a runner anywhere from 1 to 4 feet in length that is rather rigid and does not provide the cushioning or spring effect of typical snow skis.

Many different approaches to the mounting of endless tracks have been proposed. One seemingly successful approach to the mounting of such belts and chains on the runners is that of an endless guide track around which the belt or chain is supported on a plurality rollers. The tracks, however, are extremely rigid and fail to produce the cushioning or spring effect of the customary snow ski. The lack of flexibility results in a rough ride over the ski surface unless the surface is smooth.

It is desirable that grass skis be available which closely simulate the effect of snow skis.

SUMMARY AND OBJECTS OF THE INVENTION

It is the primary object of the present invention to provide an improved grass ski.

In accordance with the primary aspect of the present invention, a grass ski of the track laying type employs a runner defined by an endless guide track having spring characteristics and means for progressively increasing the spring rate of the runner in proportion to deflection thereof.

BRIEF DESCRIPTION OF THE DRAWINGS

The above and other objects and advantages of the present invention will become apparent from the following description when read in conjunction with the drawings wherein:

FIG. 1 is a side elevation view of a preferred embodiment of the invention;

FIG. 2 is a section view taken generally on line 2—2 of FIG. 1;

FIG. 3 is an enlarged partial side elevation view of the embodiment of FIG. 1;

FIG. 4 is a view like FIG. 2 showing an alternate position of a portion of the device; and FIG. 5 is a view like FIG. 3 of an alternate embodiment of the deflection restraining means.

DETAILED DESCRIPTION OF A PREFERRED EMBODIMENT

Referring to FIG. 1 of the drawing, a grass ski in accordance with the invention is designated generally by the numeral 10. This grass ski is constructed to have an endless track that is continuously laid down in front of the device as it moves over the surface of the ground.

The grass ski comprises an elongated runner in the form of an endless loop track having lower and upper generally parallel portions 12 and 14 merging together at the ends by generally semicircular portions 16 and 18. The continuous loop guide track is formed of a member that is generally channel-shaped in cross-section as shown in FIG. 2, having a central groove between side rail portions which are engaged by a plurality of rollers for carrying an endless belt 20. The belt 20 is constructed of a suitable high strength material such as nylon webbing or the like and is supported and mounted on the track by a plurality of truck assemblies designated generally by the numeral 22. Each of the truck assemblies comprise a generally U- or channel-shaped frame or housing member 24 in which is mounted a pair of front rollers 26 and a pair of back rollers 28, each pair mounted on a common axle 30 and 32, respectively. These rollers are preferably in the form, as illustrated, having end flanges overlapping the edges of the guide track to maintain the positioning thereof on the track.

These truck assemblies 22 are attached to the belt by means of a lug 34 which is attached by screws or rivets 36 through the belt to the truck housing member 24. The lugs 34 also give the endless track means for gripping the ground and driving the endless belt or track along the guide track. The truck housing includes overlapping fingers 38 that overlap the guide track for retaining the movable track on the fixed guide track. The endless belts spread the weight on the ski over a large surface area for support of a skier.

A boot binding assembly including a support platform 40 which is supported by a pair of brackets 42 and 44 which have a generally U- or V-shape that is secured to the upper portion 14 of the fixed guide track and to a support beam 46 that is secured between the upper and lower portions of the guide track.

As previously explained, the guide track 12, 14, 16, and 18 is preferably constructed of a flexible spring-like material which will flex under the weight of an individual so as to give the flexing characteristics of snow skis. Means are then provided for restraining or constraining the amount of flex in the guide track. A preferred construction of the track is that of fiberglass which has a high strength lightweight and the desired flexibility. Other materials may be utilized such as thin spring steel and similar materials.

The beam 46 is designed to provide progressive resistance to the displacement of the lower track portion 12 as the lower portion is displaced upward against the tapered front and back end displacement limiting members or ramps 48 and 50. As seen in FIGS. 3 and 4, the guide track deflects upward and progressively engages the limiting surfaces 54 on both ends of the beam 46. The resistance to deflection progressively increases as the contact of the guide track with the limiting surface moves toward the outer end of the beam 46. Thus, the deflection force progressively increases with the degree of deflection. This provides an arrangement wherein the grass ski provides a reaction simulating that of a snow ski as the skier moves over moguls and similar structures on the ski slope.

The ski is preferably constructed on the order of between about 14 inches minimum for the smaller skis for children and the like up to a maximum length of on the order of about 30 inches for adults. The degree of flex is preferably such that the shorter skis flex an amount of about ½ inch with the longer skis deflecting on the order of about 1½ inches. The spring rate or stiffness of the guide track can also be adjusted during the manufacturing process for heavier individuals. For example, a ski of a given length can be designed to carry an individual who weighs from between 100 and 150 pounds whereas a ski of the same length can be designed also for persons who weight 200 or more pounds and thereby provide the same deflection under the same circumstances for the different weights.

Referring now to FIG. 5, an alternate embodiment of the invention is illustrated wherein like numbers identify like elements within the system and wherein the deflection limiting portion of the ski includes a progressively increasing spring stiffness as opposed to the cam or ramp limiting of the previous embodiment. In this embodiment wherein a series of springs 56 through 62 in the neighborhood of about 4 to 5 springs is positioned between the upper and lower portions of the endless guide track. These leaf springs 56 through 62 are stepped in length with the longest one engaging the lower portion of the track 12 and step progressively shorter upward to the top portion of the track for progressively increasing the reflection resistance of the guide track in proportion with its deflection. It will be appreciated as the forward or rearward end of the runner or guide track deflects it progressively forces the spring upward progressively deflecting each successive leaf thereby increasing the resistance to deflection. This provides a progressive increase in the resistance to deflection as the deflection increases.

While I have illustrated and described my invention by means of specific embodiments, it is to be understood that numerous changes and modifications may be made therein without departing from the spirit and scope of the invention as defined in the appended claims. For example, the track could be made to have the restraining means incorporated in its structure by selecting a material and/or dimensioning the track to provide the limited degree of flexibility sought.

I claim:

1. A grass ski comprising:

an endless guide track constructed to resiliently flex under the weight of a skier to give the flexing characteristics of a snow ski;

a boot attachment mounted to said guide track for attachment to a boot;

an endless belt movably mounted on said guide track for traveling along said track; and a cantilevered beam extending parallel to a portion of said guide track, said beam having a forward surface and a rearward surface which diverge away from said portion of said guide track and which are progressively engaged by said portion of said guide track as a pair of opposite ends of said guide track flex toward said boot attachment.

2. The grass ski of claim 1 wherein said guide track is a channel.

3. The grass ski of claim 2 wherein said channel is constructed of a plastic material.

4. The grass ski of claim 2 wherein said channel includes side flanges lying in a common plane.

5. The grass ski of claim 3 wherein said channel includes a pair of side flanges lying in a common plane.

6. The grass ski of claim 1 wherein said beam has an intermediate segment secured to said boot attachment.

7. The grass ski of claim 1 wherein said guide track is constructed to flex between about one-half inch and about one and one-half inches.

8. An endless track for a grass ski, said track comprising:

a continuous loop flexible track member having upper and lower substantially parallel portions connected by substantially semicircular end portions for supporting an endless belt for traveling therealong and being deflectable at the ends thereof under normal loading conditions;

a support member for supporting said track member for attachment to the feet of a skier; and constraining means for progressively constraining the deflection of the end portions of said track member including a tapered beam having a center portion secured between said upper and lower parallel portions, the tapered beam having cantilevered end portions extending toward said semicircular end portions of said track member and each including a downwardly facing surface which diverges away from the lower parallel track portion.

9. An endless track for a grass ski, said track comprising:

a continuous loop flexible track member having upper and lower substantially parallel portions connected by substantially semicircular end portions for supporting an endless belt for traveling therealong and being sufficiently flexible to flex between about one-half inch and about one and one-half inches at the ends thereof under normal loading conditions of a skier of a predetermined weight;

a support member for supporting said track member for attachment to the boots of a skier; and constraining means including a tapered beam having an intermediate segment secured between said upper and lower parallel portions, said beam further having cantilevered end portions extending toward said semicircular end portions, the cantilevered end portions each having a downwardly facing surface which diverges away from said lower parallel track portion.

* * * * *